US009038200B2

(12) United States Patent
McNair

(10) Patent No.: US 9,038,200 B2
(45) Date of Patent: May 26, 2015

(54) FOOTWEAR REMOVER AND DRYING RACK

(76) Inventor: Eric Matthew McNair, San Carlos, CA (US)

( * ) Notice: Subject to any disclaimer, the term of this patent is extended or adjusted under 35 U.S.C. 154(b) by 368 days.

(21) Appl. No.: 12/770,724

(22) Filed: Apr. 30, 2010

(65) Prior Publication Data

US 2011/0089203 A1 Apr. 21, 2011

Related U.S. Application Data

(60) Provisional application No. 61/279,006, filed on Oct. 15, 2009.

(51) Int. Cl.
*A47G 25/80* (2006.01)
*A47G 25/86* (2006.01)

(52) U.S. Cl.
CPC ..... *A47G 25/86* (2013.01)

(58) Field of Classification Search
CPC ..... A47G 25/86
USPC ..... 223/1, 111, 113, 114, 120
See application file for complete search history.

(56) References Cited

U.S. PATENT DOCUMENTS

| | | | | | |
|---|---|---|---|---|---|
| 63,844 | A | * | 4/1867 | Boss | 223/114 |
| 530,080 | A | * | 12/1894 | Bisanz | 223/113 |
| D59,183 | S | * | 10/1921 | Sagedy | D5/37 |
| 2,603,393 | A | | 7/1952 | Oblusteel | |
| 2,741,410 | A | * | 4/1956 | La Violette | 223/111 |
| 2,876,942 | A | | 3/1959 | Johnson | |
| 2,889,972 | A | * | 6/1959 | Johnson | 223/114 |
| 3,333,749 | A | * | 8/1967 | Buzzelli | 223/111 |
| 3,490,661 | A | * | 1/1970 | Williams | 223/114 |
| 3,623,640 | A | * | 11/1971 | Zalejski | 223/114 |
| 3,802,572 | A | | 4/1974 | Shackel | |
| 4,228,935 | A | * | 10/1980 | Madray | 223/111 |
| 4,530,168 | A | * | 7/1985 | Petre | 34/106 |
| 4,879,956 | A | * | 11/1989 | Shuert | 108/53.3 |
| 5,050,784 | A | * | 9/1991 | Turner | 223/114 |
| 5,152,439 | A | | 10/1992 | Simons | |
| 5,385,279 | A | * | 1/1995 | Dawson | 223/114 |
| 5,655,669 | A | | 8/1997 | Moore | |
| 5,806,729 | A | * | 9/1998 | Ramon | 223/115 |
| 6,132,002 | A | * | 10/2000 | Brown, II | 297/423.41 |
| 6,702,163 | B1 | * | 3/2004 | Hopping | 223/114 |
| D594,183 | S | | 6/2009 | Sagedy | |
| 2007/0125813 | A1 | * | 6/2007 | Portuesi et al. | 223/114 |
| 2007/0205054 | A1 | * | 9/2007 | Gentles et al. | 182/230 |
| 2009/0236377 | A1 | * | 9/2009 | Selvarajah | 223/115 |
| 2010/0065592 | A1 | * | 3/2010 | Fard | 223/113 |

FOREIGN PATENT DOCUMENTS

| | | |
|---|---|---|
| JP | 2002300956 | 10/2002 |

* cited by examiner

*Primary Examiner* — Shaun R Hurley
*Assistant Examiner* — Andrew W Sutton
(74) *Attorney, Agent, or Firm* — The Mueller Law Office, P.C.

(57) ABSTRACT

A footwear remover has a platform elevated above the ground, with one or more recesses in the platform for removing footwear. The platform provides sufficient surface area to allow a user to place an unshoed, clean foot away from where a soiled shoe was previously positioned. In one embodiment, the footwear remover may be mounted to a suspending surface and used as a drying and storage rack for footwear. The footwear remover may optionally include hanging features for drying and hanging accessory items.

22 Claims, 6 Drawing Sheets

FOOTWEAR REMOVER AND DRYING RACK

RELATED APPLICATIONS

This application claims priority to U.S. Provisional Patent Application Ser. No. 61/279,006 filed Oct. 15, 2009, entitled "Boot and Shoe Remover," which is hereby incorporated by reference for all purposes.

BACKGROUND OF THE DISCLOSURE

Shoe removers and bootjacks have taken many forms. Typically, a user places the heel of their shoe or boot in a recess or other holding mechanism of the jack, and then pulls their foot out of the shoe. Bootjacks may have one recess for removing a boot, in which the user stands on the ground to remove a first shoe and then switches feet to remove the remaining shoe. Other shoe or bootjack designs provide an area on which both feet may stand. In these designs, typically the user engages one foot in a first recess to remove a first piece of footwear and then switches feet to remove the other item of footwear with a second recess. In all these cases, it can be difficult for a user to remain steady while removing footwear. Moreover, once a boot is removed, the user must place their foot in the area where the dirty boot was, or on the ground. This can cause the user's foot or stocking foot to become soiled, wet or muddy. Furthermore, additional equipment may be required for drying and storage of soiled footwear. Improper drying of footwear, particularly in uses such as hunting or fishing, may lead to deterioration of the footwear due to mold or mildew. Improper drying can also have detrimental environmental effects, such as contributing to Aquatic Nuisance Species (ANS) contamination.

Thus, it is desirable to provide a footwear remover that enables a user's feet to remain clean after removing their shoes or boots. It is also desirable to facilitate more thorough drying of footwear.

SUMMARY OF THE DISCLOSURE

A footwear remover provides a platform on which a user may stand during and after removing footwear. The platform is designed with enough space so that the user's clean, unshoed feet may stand in an area away from where the original soiled footwear was placed. Footwear is removed by engaging a heel into a recess in an edge of the platform. The platform elevates the user above the ground and away from the dirtied footwear.

The footwear remover may optionally be converted to a drying assembly by mounting it to a suspending surface. Footwear may be hung upside down from the recesses in the platform to promote thorough drying of the footgear. In some embodiments, the footwear remover may be equipped with hanging and storage features to accommodate clothing items and other accessories.

BRIEF DESCRIPTION OF THE DRAWINGS

Reference now will be made in detail to embodiments of the disclosed invention, one or more examples of which are illustrated in the accompanying drawings.

DETAILED DESCRIPTION OF THE EMBODIMENTS

A footwear remover is disclosed which advantageously enables a user's hands and feet to remain clean and dry after removing soiled gear. The device of the present invention may be used in applications such as, but not limited to, hunting, fishing, gardening, construction, hiking, snow recreation, military, hazardous materials, firefighting, and equestrian. The term footwear used in this disclosure may refer to shoes, boots, waders, or other foot coverings. Additionally, the terms remover, puller and jack may be used interchangeably throughout.

Figure 1:
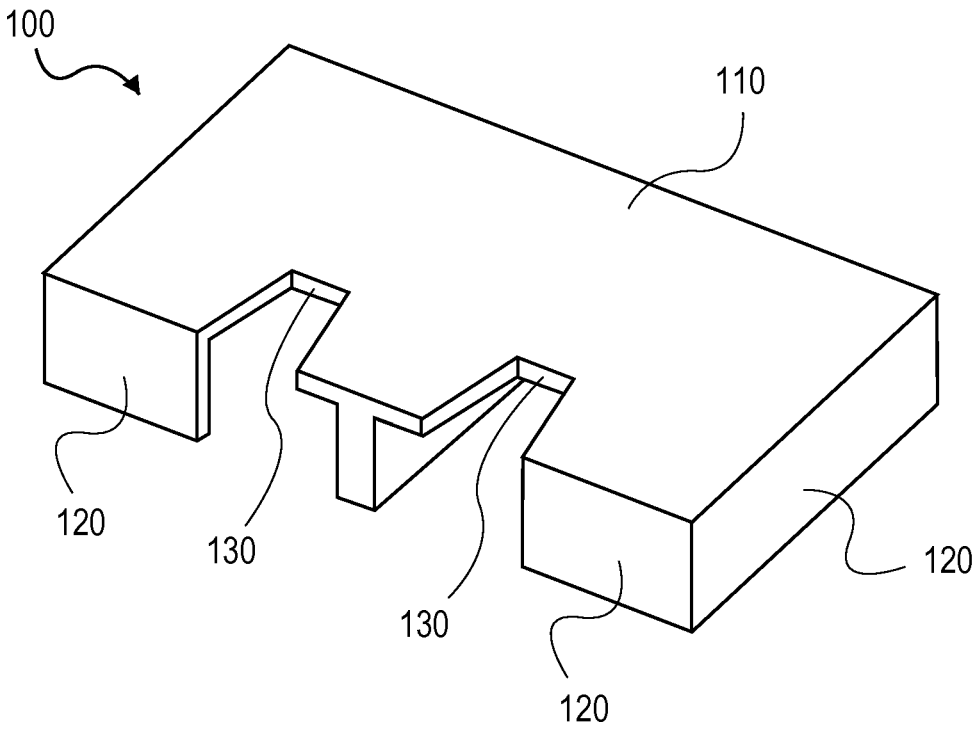
FIG. 1 illustrates a perspective view of an embodiment of a footwear remover of the present invention.

FIG. 1 illustrates a perspective view of footwear remover 100 which includes a platform 110, supports 120, and recesses 130. In the embodiment shown, supports 120 are side walls coupled to the platform 110 to raise the platform 110 to a desired height above the ground. This elevation beneficially keeps the user away from dirt, dust, mud, wetness, snow, and the like. In other embodiments, supports 120 may take other forms such as individual legs or trusses, and may be fixed or foldable. The supports 120 may be integral to the platform 110, or may be separate components attached to the platform 110. The wide base created by supports 120 provides stability for a user regardless of the location in which a user is standing on platform 110. The height of the supports 120 may be chosen to suit the desired type of footgear and environment in which it is to be used. For instance, a footwear remover 100 designed for use in snow recreation may be fabricated with higher supports 120 to keep a user above the snow depth than one designed for use in hiking or gardening situations where the ground is more solid. To accommodate different types of footwear, supports 120 may have a height on the order of, for example, two inches such as for children's footgear, or three to six inches for working boots (e.g. hunting, construction, military). In one embodiment the height of supports 120 may be, for example, three inches. The elevation provided by supports 120 also advantageously keeps the soiled footwear beneath the platform 110 and away from the user's feet.

Footwear remover 100 can be manufactured with different materials such as wood, metal, or plastic. In some embodiments, the material may be chosen to allow the platform to be lightweight and portable, and also easily cleaned. Additional structural elements (not shown) such as, but not limited to ribs, cross beams, and footings may be present on the underside of platform 110 as necessary. Such structural elements may supplement supports 120 to provide additional structural integrity and durability to the apparatus.

Platform 110 is designed with a surface area sufficient to accommodate a person standing on the platform and stepping aside with at least one of their feet from the area in which they were initially standing. For example, with a user initially standing on the platform 110 wearing gear on both feet, the platform 110 allows placement of at least the two shoed feet plus one unshoed foot in distinct areas from each other during the period of time in which the user is removing their shoes. In another example, the platform 110 may accommodate one shoed foot and two unshoed feet on the platform, with each of the shoed and unshoed feet having separate placement areas from each other. The platform may have a width of, for example, 10 to 15 inches and a length of 12 to 28 inches. In one embodiment, example dimensions may be 13 inches wide by 24 inches long. The surface area of the platform 110 beneficially provides a distinct clean space for a user to place their unshoed foot, rather than locating their shoeless foot where their dirty boot or shoe was standing previously. Furthermore, the resulting wide base of shoe remover 100 provides stability for the platform 110, even at the various heights to which it may be elevated.

Although the platform 110 is shown to have a rectangular shape in FIG. 1, it may have other shapes such as trapezoidal or square, and may have a modified perimeter such as rounded corners for aesthetics or textured edges for scraping debris from footwear. Platform 110 may incorporate holes, channels, or the like to keep water and debris from collecting on the surface, or to create a non-skid surface. Platform 110 may be level, or alternatively, some or all of platform 110 may be positioned at an angle. Having an inclined platform 110 may, for instance, provide leverage when pulling off footgear, or allow for drainage away from the user's clean feet.

Recesses 130 are designed to receive the heel of a shoe, and are depicted in FIG. 1 as having a notched V-shape. This angled shape, being wider at the front edge, enables various sizes and types of boots to be engaged by footwear remover 100. Alternatively, other shapes known in the art, such as curved U, may be employed. While two recesses 130 are shown in FIG. 1 for ease of use in removing the right or left shoes, it is also possible to have a single recess. In other embodiments, more than two recesses may be incorporated. For example, multiple recesses in different sizes and shapes may be incorporated along any edge of platform 110, to accommodate various types and sizes of footwear.

Figure 2A:
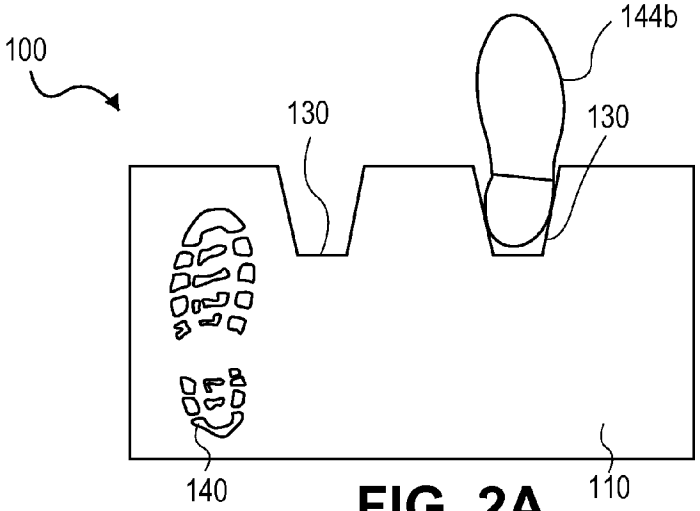
FIGS. 2A-2D are top views of the footwear remover of FIG. 1 in one exemplary mode of use.
Figure 2B:
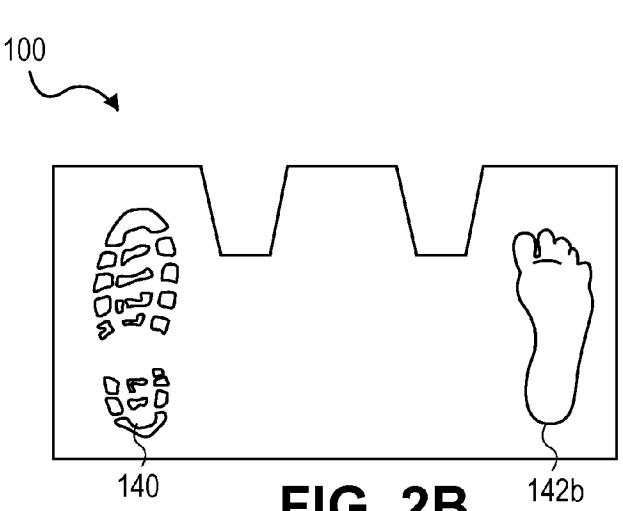
Figure 2C:
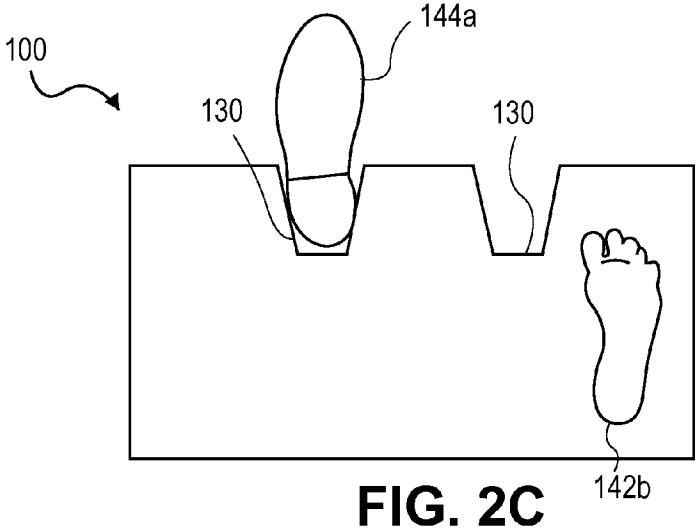
Figure 2D:
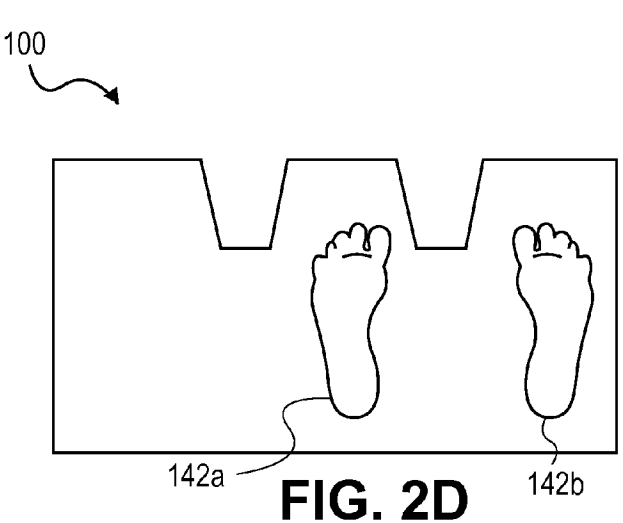
Figure 3:
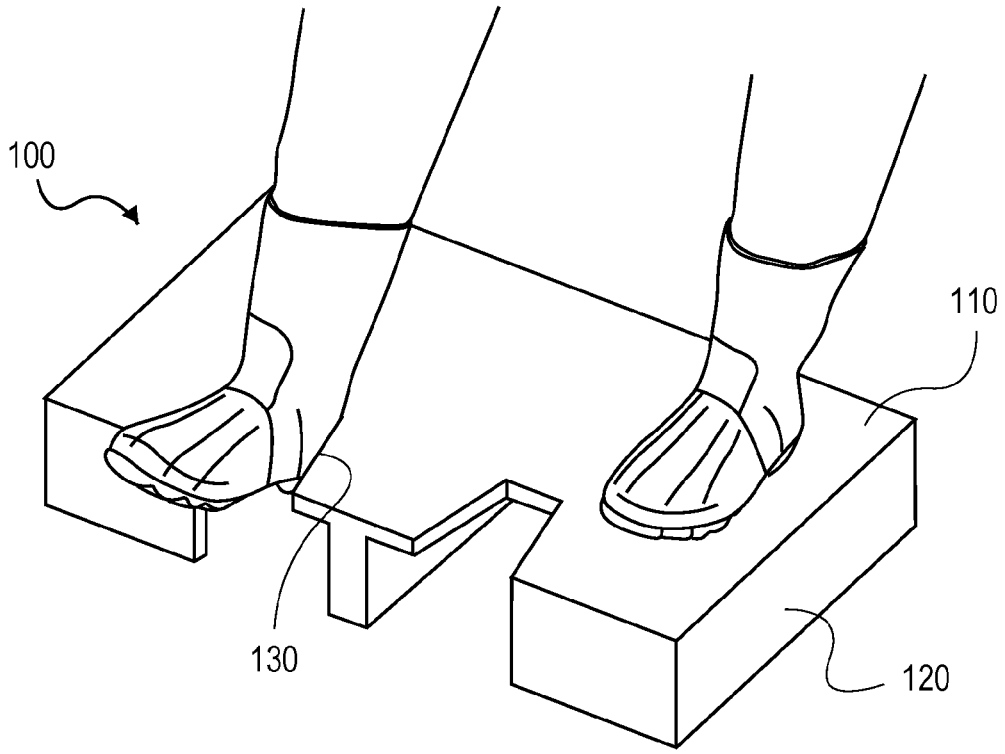
FIG. 3 is a perspective view of a footwear remover in use.

FIGS. 2A-2D are top views of the shoe remover 100 illustrating one exemplary mode of operation. In FIG. 2A, a user steps up with their dirty, wet, muddy, or otherwise contaminated shoe onto the top surface of platform 110, for example in position 140 on the left side of the platform 110. While standing on their left foot in position 140, the user places the right shoe 144*b* in either one of the recesses 130 as shown in FIG. 2A and FIG. 3, and pulls their heel out of the shoe while the shoe is held by recess 130. The now unshoed right foot may be placed in clean position 142*b* on the right side of the platform 110 as shown in FIG. 2B. The user may then remove the remaining shoe 144*a* using either recess 130 as shown in FIG. 2C, while their unshoed foot remains unsoiled in position 142*b*. After removal of the second shoe, the user may stand with both feet in clean positions 142*a* and 142*b*, as illustrated in FIG. 2D. Clean positions 142*a* and 142*b* for the unshoed feet are distinct and separate from the shoed position 140. Because shoe remover 100 has a wide base area, the shoe remover 100 remains stable as the user stands in the various positions on the platform 110 despite being raised above the ground by the height of supports 120.

Figure 4:
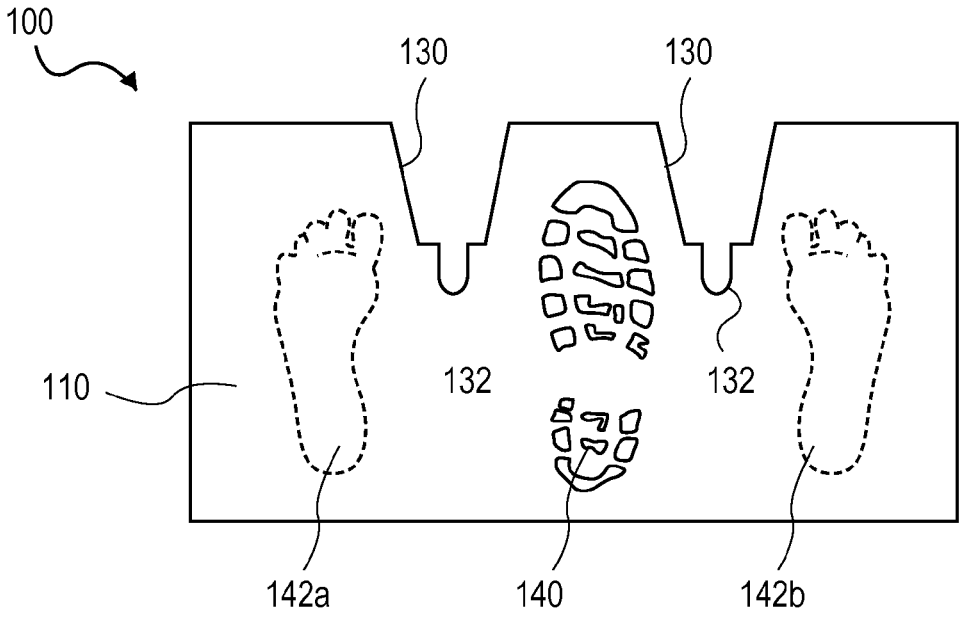
FIG. 4 shows another top view of the footwear remover of FIG. 1 in another exemplary mode of operation.

In another exemplary mode of operation illustrated in FIG. 4, the user may step onto shoe remover 100 with a first soiled shoe in position 140 in the center of platform 110. The remaining shoe is removed via either of the recesses 130, after which the stockinged foot is placed into clean position 142*a* or 142*b* to the sides of the dirtied position 140. Next the user removes their first shoe, which was previously in position 140. After both shoes have been removed, the two clean feet may be placed in positions 142*a* and 142*b*. Also shown in FIG. 4 are recesses 130 that have been modified with extensions 132. Extensions 132 are slots or additional notches that may be used to wedge the shaft portion of a boot, such as to assist in holding larger or heavier boots during drying (e.g., FIG. 5A). Extensions 132 may have various lengths and widths as necessary to accommodate various types of footwear.

Note that while the embodiments of FIGS. 2-4 are shown to provide space for clean feet to step to the side of the soiled areas, other configurations are possible. For example, a square platform may allow clean feet to be placed behind the dirtied areas. In yet another embodiment, a user may step onto the shoe remover 100 with two soiled boots. In this case, the platform 110 still provides sufficient space for at least one unshoed foot to be placed away from the dirtied areas during the period of time during which the user is removing their footwear. In a yet further embodiment, platform 110 may be designed with enough space to accommodate two soiled shoes and the placement of two clean feet in separate areas from where the soiled shoes were located.

Figure 5A:
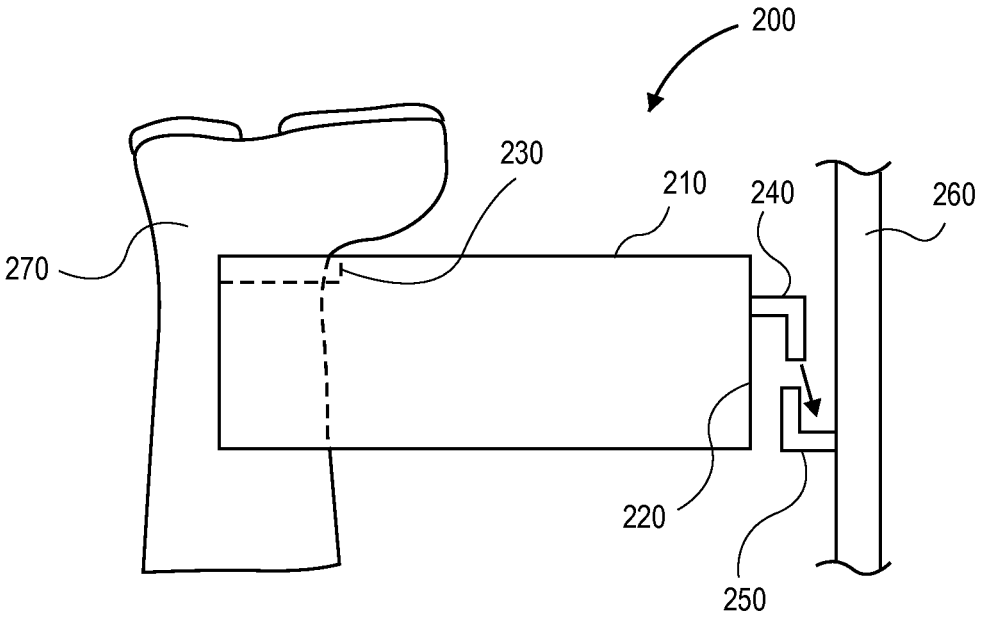
FIGS. 5A-5B depict a footwear remover converted to a drying rack, and an exemplary mounting bracket.

FIG. 5A shows another embodiment of the present invention, in which a footwear remover 200 advantageously serves as both a boot puller and as a storage and drying rack. In this embodiment, rear support 220 is configured with a hook 240 that mates with a mounting device in the form of a bracket 250 attached to vertical surface 260. Hook 240 and bracket 250 may have lengths similar to the length of the footwear remover 200, or may be two or more individual hooks 240 and brackets 250 positioned apart from each other. Vertical surface 260 may be, for example, a wall, a portable board, or a door. Footwear remover 200 is configured in FIG. 5A to be detachably mounted to vertical surface 260, via hook 240 and bracket 250, which beneficially enables a user to transport footwear remover 200 to their working location when needed, or to be stored away when not in use. Having footwear remover 200 being removable from vertical surface 260 meets a long-felt need for a footwear remover which keeps the user clean during use, is portable, and is convertible for different purposes such as a storage or drying rack.

When mounted on a wall or other surface, footwear remover 200 may serve as a drying rack for footwear after they are washed. For example, boot 270 is seen in FIG. 5A to be hung from recess 230 in an upside down position. The front portion of boot 270 rests on top surface 210. Alternatively, boot 270 may be hung from the heel instead of the toe. This inverted position helps to drain moisture or water from boot 270, thus promoting thorough drying so that bacteria, mold, or other damaging substances may be prevented from deteriorating boot 270.

Figure 5B:
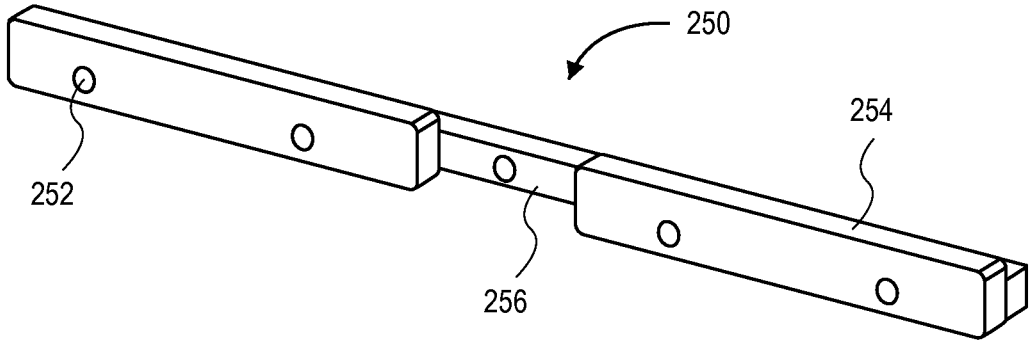

FIG. 5B shows an exemplary embodiment of the bracket 250 from FIG. 5A. In this embodiment of FIG. 5B, bracket 250 has mounting holes 252, a lip 254, and an inset area 256. Hook 240 of FIG. 5A engages lip 254 and may have a similar length as bracket 230. Hook 240 may have a protrusion (not shown) or similar feature to fit into inset area 256 to prevent hook 240 from sliding laterally along bracket 250. Bracket 250 may be mounted to vertical surface 260 with screws, nails, bolts or other fasteners placed in mounting holes 252.

Figure 6:
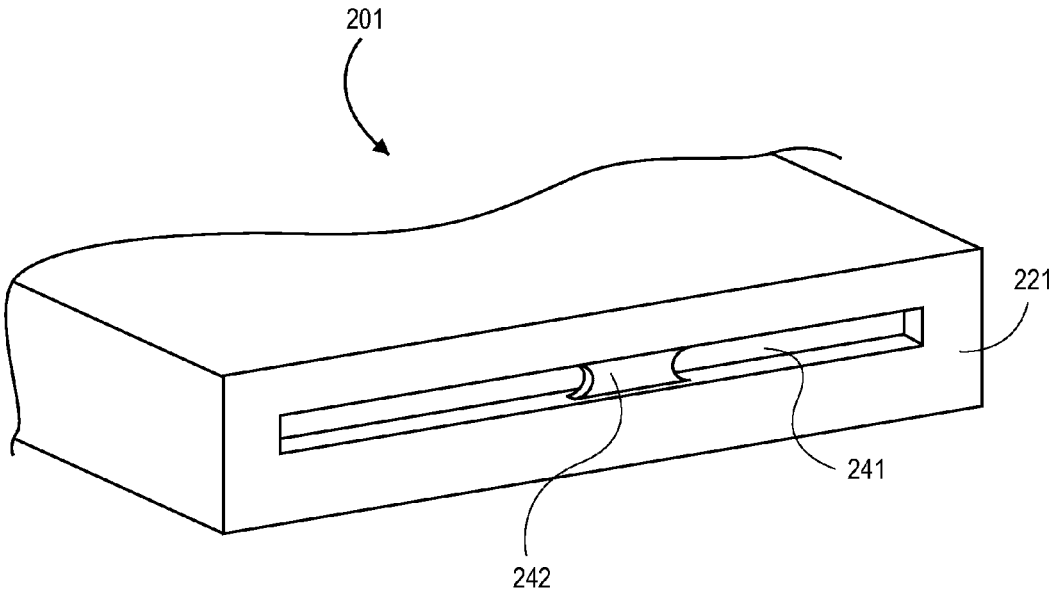
FIG. 6 illustrates a rear perspective view of another footwear remover compatible with the mounting bracket of FIG. 5B.

FIG. 6 illustrates a rear perspective view of another embodiment of a footwear remover 201 which is configured to be mated with a mounting device, such as bracket 250 of FIG. 5B. The rear support face 221 of footwear remover 201 is configured with a slot 241 into which the lip 254 of bracket 250 is inserted. Slot 241 has a bridge 242 which fits into inset area 256 of bracket 250, to help prevent lateral movement of footwear remover 201 along the bracket 250.

Mounting devices and support configurations other than bracket 250 and hook 240 may be used for mounting footwear remover 200 to vertical surface 260. Other embodiments of mounting devices to couple the footwear remover to a suspending surface include but are not limited to tracks, rails, tabs, locking clasps, clamps, pegs, or any combination of these. Corresponding configurations for supports of the footwear remover to be coupled to mounting devices include, for example, grooves, slots, notches, nubs, and the like. While the footwear removers of this disclosure have been configured to have their back support face mounted to a suspending surface, other surfaces such as the side supports or the top surface of the platform may be configured to be coupled to a mounting device. The mounting devices and corresponding joining elements on the supports can be manufactured with various materials such as wood, metal, or plastic. Alternatively, the supports may be configured for mounting by for example, attaching hardware to the supports, by insert molding components, or by integrally forming features into the supports such as by machining or injection molding.

Figure 7:
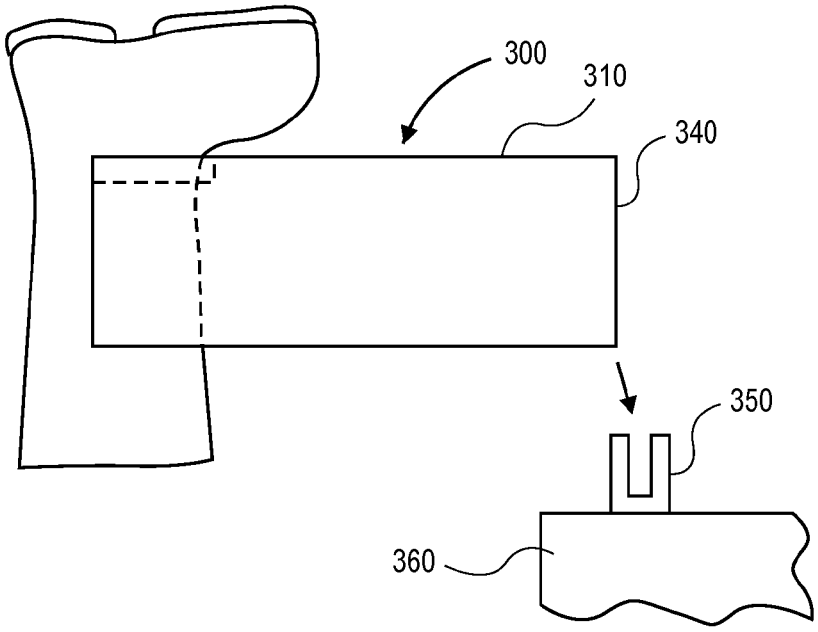
FIG. 7 shows another embodiment of a footwear remover being used as a drying rack.

FIG. 7 depicts a side view of a footwear remover 300 mounted to a horizontal suspending surface 360, such as the top of a cabinet, instead of a vertical surface. In this embodiment, a mounting device 350 is in the form of a U-shaped bracket that provides a slot in which to insert the rear support wall 340 of footwear remover 300. As described above in relation to FIG. 5, other mounting devices are possible such as hooks, tracks, and the like. Top surface 310 of footwear remover 300 may additionally be used as a storage shelf when mounted on a suspending surface 360. For instance, containers, boxes, and recreational accessories may be placed onto top surface 310 when used as a shelf.

Figure 8:
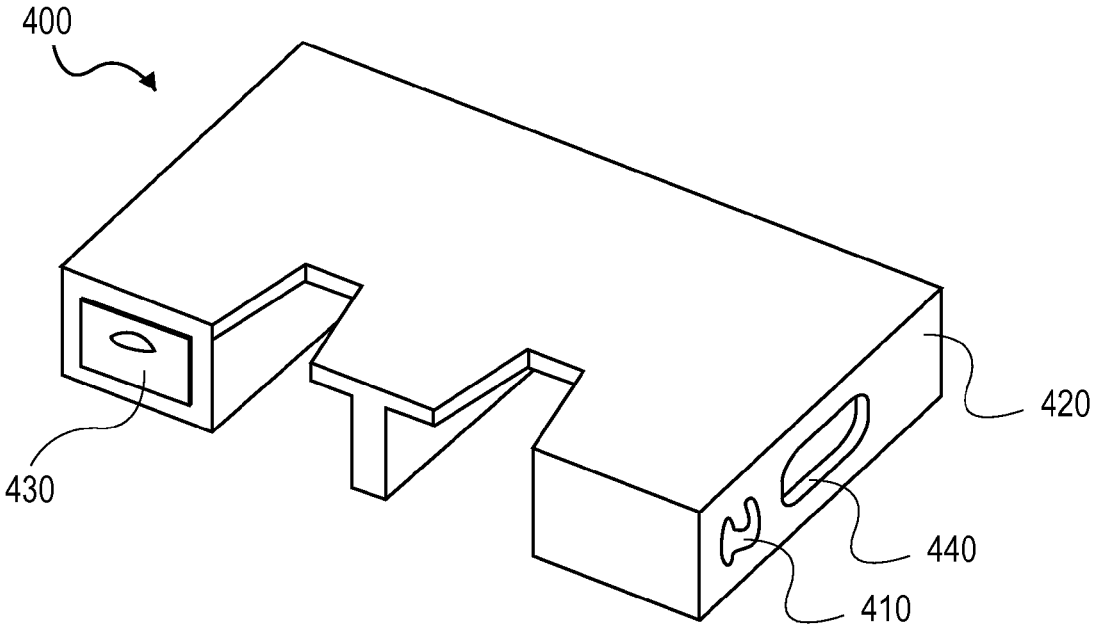
FIG. 8 is a perspective view of a footwear remover with accessory features.

FIG. 8 illustrates yet another embodiment of a footwear remover 400 with an optional hanging element 410 for drying or storing clothing articles such as hats, straps, lanyards, belts, coats, gloves, scarves, and other accessory items. Hanging element 410 may be in the form of hook on side support face 420, or may alternatively be a nub, clip, peg, indentation, recessed hook, claw, clasp, hasp, clamp, button or the like. Multiple hanging elements 410 may be incorporated into one or more locations on footwear remover 400. Hanging element 410 may be positioned to allow a clothing hangar to hang from it when footwear remover 400 is mounted to a wall or other suspending surface. The hanging element 410 can be manufactured with various materials such as metal, wood, or plastic, and can be separate pieces attached to the platform or may be integrally formed with the platform. The hanging element 410 can be located on the inside, outside, or front of the platform. In some embodiments, hanging elements 410 may be flush with the surface in which they are situated, to facilitate portability of the platform and to help prevent breakage of the hanging features.

FIG. 8 also shows an optional storage drawer 430 underneath the platform surface. While shown in this embodiment to be accessed from the front face of footwear remover 400, storage drawer 430 may alternatively be placed in any face of the footwear remover 400. Storage drawer 430 may be used to store items such as gloves, socks, or straps. Footwear remover 400 may additionally include an optional handle 440 on side support 420 to facilitate carrying the device to work or to recreational locations. Handle 440 may take the form of a finger hole as shown, a strap, a protruding handle, or the like. Handle 440 may be located on one or more faces of footwear remover 400, including the top surface, to facilitate carrying footwear remover 400 with two hands.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the spirit and scope of the present invention, which is more particularly set forth in the appended claims. Furthermore, those of ordinary skill in the art will appreciate that the foregoing description is by way of example only, and is not intended to limit the invention. Thus, it is intended that the present subject matter covers such modifications and variations as come within the scope of the appended claims and their equivalents.

What is claimed is:

1. A device for removing footwear, comprising:

a platform having a top surface and edges, wherein the top surface has an area, wherein a first portion of the area is capable of accommodating at least one entire shoed foot, and wherein a second portion of the area and a third portion of the area are each capable of accommodating at least one entire unshoed foot, and wherein each of the first, second and third portions of the area for the one entire shoed foot and the two entire unshoed feet are distinct from each other;

supports coupled to the platform, wherein the supports are configured to extend to the ground and raise the platform to a height above the ground, and wherein the supports comprise a joining element adapted to be mounted to a suspending surface such that the platform and supports are horizontally suspended above the ground when mounted to the suspending surface; and a recess located at an edge of the platform, wherein the recess is shaped to receive a heel of an item of footwear;

wherein the platform is capable of accommodating and fully supporting a user standing on the platform with a first entire shoed or unshoed foot placed in one of the portions of the area at the same time as a second entire shoed or unshoed foot is placed in a different portion of the area.

2. The device of claim 1 further comprising two recesses, wherein the recesses accommodate hanging and drying footwear in an upside down position when the joining element is mounted to the suspending surface.

3. The device of claim 1 wherein the height of the platform is at least 3 inches.

4. The device of claim 1 wherein the top surface has a length of at least 12 inches, wherein the length of the platform is measured in a direction across the width of the at least one entire shoed foot and the two entire unshoed feet.

5. The device of claim 1 further comprising two recesses, wherein each recess is between two of the portions; wherein the platform remains stable when the user stands on the platform with any combination of shoed and unshoed feet, and with one foot or two feet in any combination of the first, second and third portions of the area at one time; and wherein the platform remains stable when the user stands on the platform with one entire foot in any portions of the area at the same time as a second foot is placed in the recess.

6. The device of claim 1 wherein the suspending surface is a vertical wall.

7. The device of claim 1 further comprising a mounting device, wherein the mounting device couples the joining element of the supports to the suspending surface.

8. The device of claim 7 wherein the supports and the mounting device are detachably coupled.

9. The device of claim 1 further comprising a hanging element located on the supports.

10. The device of claim 1 wherein the top surface of the platform is used as a shelf when the joining element is mounted to the suspending surface.

11. An apparatus for removing and drying footwear, comprising:

a platform having a top surface and edges, wherein the top surface has an area, wherein a first portion of the area is capable of accommodating at least one entire shoed foot, and wherein a second portion of the area and a third portion of the area are each capable of accommodating at least one entire unshoed foot, wherein each of the first, second and third portions of the area for the one entire shoed foot and the two entire unshoed feet are distinct from each other;

supports coupled to the platform, wherein the supports are configured to extend to the ground and raise the platform to a height above the ground, and wherein the supports comprise a joining element adapted to be mounted to a suspending surface;

two recesses at an edge of the platform, wherein the recesses are shaped to receive a heel of an item of footwear, and wherein each recess is between two of the portions;

wherein the platform is capable of accommodating and fully supporting a user standing on the platform with a first entire shoed or unshoed foot placed in one of the portions of the area at the same time as a second entire shoed or unshoed foot is placed in a different portion of the area, and wherein the platform is capable of accommodating and fully supporting the user standing on the platform with one entire foot in any portions of the area at the same time as a second foot is placed in the recess; and a mounting device capable of being mounted to a suspending surface, wherein the joining element of the supports is configured to be coupled to the mounting device such that the platform and supports are horizontally suspended above the ground when mounted to the suspending surface.

12. The apparatus of claim 11 wherein the mounting device is a bracket.

13. The apparatus of claim 11 wherein the mounting device and the supports are detachably coupled.

14. The apparatus of claim 11 wherein the suspending surface is a vertical wall.

15. The apparatus of claim 11 further comprising a hanging element located on the supports.

16. The apparatus of claim 11 wherein the top surface has a length of at least 12 inches.

17. The apparatus of claim 11 wherein the height of the platform is at least 3 inches.

18. The apparatus of claim 11 wherein the recesses accommodate hanging and drying footwear in an upside down position when the joining element is mounted to the suspending surface.

19. The device of claim 4 wherein the first portion of the area for the shoed foot is sufficiently separated from the second and third portions for the unshoed feet such that when the first portion for the shoed foot becomes soiled, the second and third portions for the unshoed feet remain unsoiled.

20. The apparatus of claim 16 wherein the first portion of the area for the shoed foot is sufficiently separated from the second and third portions for the unshoed feet such that when the first portion for the shoed foot becomes soiled, the second and third portions for the unshoed feet remain unsoiled.

21. The device of claim 2 further comprising a hanging element located on the supports and at a different edge of the platform than the recesses, wherein the hanging element is configured to hang an accessory at the same time as the footwear is drying in the recesses.

22. The device of claim 18 further comprising a hanging element located on the supports and at a different edge of the platform than the recesses, wherein the hanging element is configured to hang an accessory at the same time as the footwear is drying in the recesses.

* * * * *